US011192267B1

(12) United States Patent
Omelchenko et al.

(10) Patent No.: US 11,192,267 B1
(45) Date of Patent: Dec. 7, 2021

(54) LOCKING FOLDING KNIFE WITH CLIP ACTUATOR

(71) Applicants: Anatoliy Omelchenko, Brooklyn, NY (US); Nataliia Omelchenko, Brooklyn, NY (US)

(72) Inventors: Anatoliy Omelchenko, Brooklyn, NY (US); Nataliia Omelchenko, Brooklyn, NY (US)

( * ) Notice: Subject to any disclaimer, the term of this patent is extended or adjusted under 35 U.S.C. 154(b) by 0 days.

(21) Appl. No.: 16/993,647

(22) Filed: Aug. 14, 2020

(51) Int. Cl.
*B26B 1/04* (2006.01)
*A45F 5/02* (2006.01)

(52) U.S. Cl.
CPC ..... *B26B 1/048* (2013.01); *A45F 5/022* (2013.01)

(58) Field of Classification Search
CPC ..... B26B 1/048; B26B 1/04; B26B 1/042; B26B 1/044; B26B 1/046; A45F 5/022
See application file for complete search history.

(56) References Cited

U.S. PATENT DOCUMENTS 1,075,519 A * 10/1913 Tillmanns ..... B26B 1/046 30/159
1,803,899 A * 5/1931 Fuller ..... B26B 1/00 24/3.12
4,947,552 A * 8/1990 Barnes ..... B26B 1/046 30/159
7,080,457 B2 * 7/2006 Sullivan ..... B26B 1/046 30/160
7,284,329 B1 * 10/2007 King ..... B26B 1/044 30/158
8,783,141 B2 * 7/2014 Caswell ..... A45F 5/02 83/13

* cited by examiner

*Primary Examiner* — Stephen Choi
(74) *Attorney, Agent, or Firm* — Larson & Larson, P.A.; Justin P. Miller; Frank Liebenow

(57) ABSTRACT

The disclosed locking folding knife with clip actuator combines a locking mechanism with a clip mechanism. This results in a reduction of the number of required parts, simplifying the knife while maintaining functionality. The blade of the knife pivots with respect to the handle. In the preferred embodiment the blade rotates about a pin, the pin optionally surrounded by a bushing. The pin about which the knife rotates is an extension of one of the arms of the clip.

11 Claims, 7 Drawing Sheets

LOCKING FOLDING KNIFE WITH CLIP ACTUATOR

FIELD

This invention relates to the field of folding knives and more particularly to a folding knife that combines a locking mechanism with a retaining clip.

BACKGROUND

It is popular to carry knife at all times for both utility and protection. Such knives are referred to as EDC or Everyday Carry—the collection of items one carries every day.

A folding knife is a common solution due to its small size and increased safety as compared to a fixed-blade knife.

Folding knives commonly include a means of locking the blade in an open position and locking in a closed position. But this ability to open and close increases the number of parts and thus complexity.

What is needed is a folding knife with integrated lock, but without the requirement of additional parts to lock or unlock the knife blade.

SUMMARY

The disclosed locking folding knife with clip actuator combines a locking mechanism with a clip mechanism. This results in a reduction of the number of required parts, simplifying the knife while maintaining functionality.

The blade of the knife pivots with respect to the handle. In the preferred embodiment the blade rotates about a pin, the pin optionally surrounded by a bushing.

The pin about which the knife rotates is an extension of one of the arms of the clip.

The second end of the clip passes through a slot in the handle, the slot guiding its motion. This second end, or second pin, slides within a curved slot within the blade. As the blade rotates, the pin moves within the curved slot.

The second pin is generally pushed outward by the clip's preferred position, thus causing the second pin to prefer to spring outward, locking into a detent just off the curved slot. When locked into a detent the second pin prevents rotation of the blade with respect to the handle.

When a user squeezes the clip, the second pin moves into the curved slot, permitting rotation and allowing the user to transition from an unfolded position to a folded position or back.

Thus, the locking mechanism is either in a locked position within a detent, or an unlocked position while the pin is permitted to move within the curved slot.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
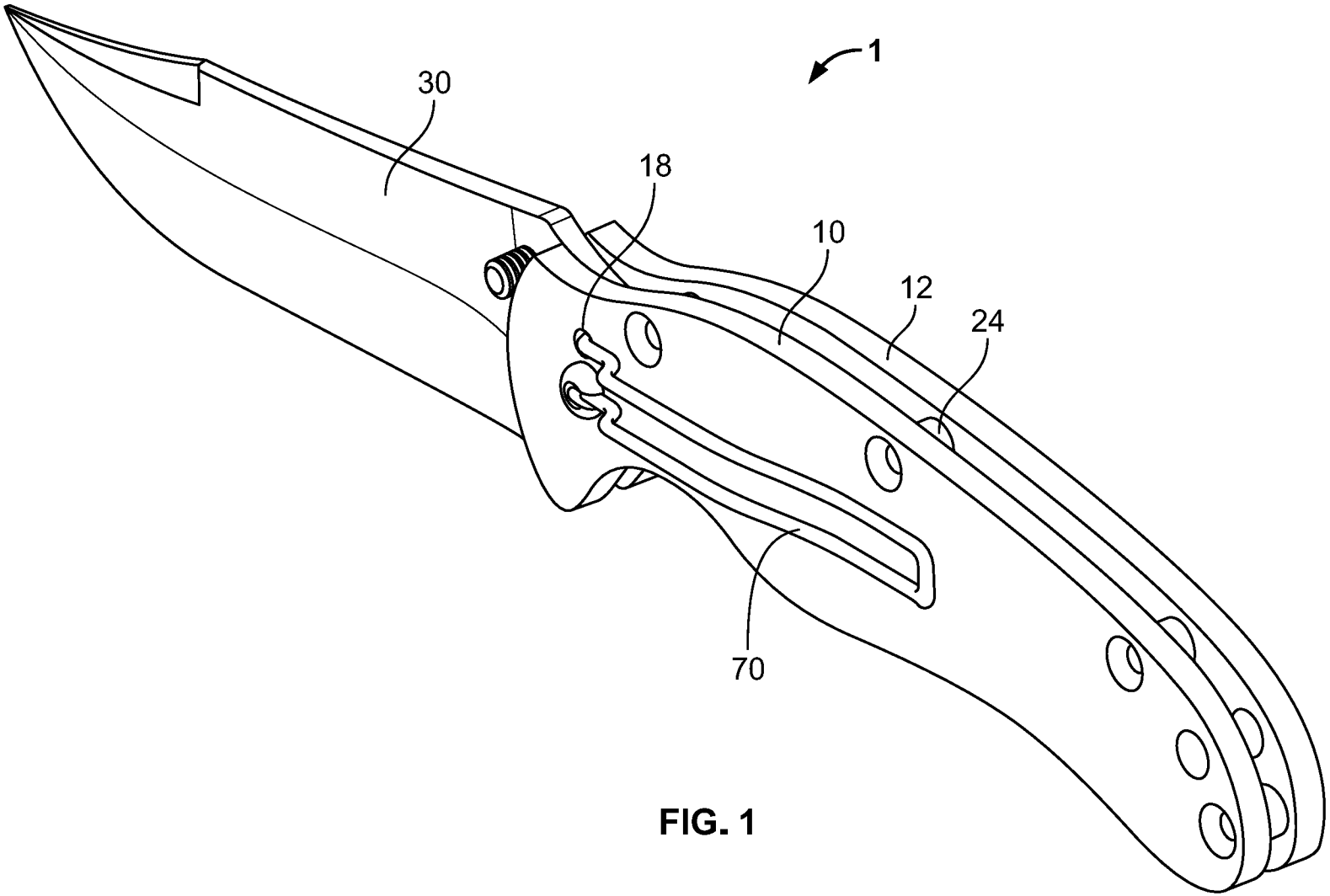
FIG. 1 illustrates a first isometric view of the locking folding knife with clip actuator.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a first isometric view of the locking folding knife with clip actuator is shown.

The locking folding knife with clip actuator 1 is shown with primary components of front handle 10, back handle 14, blade 30, and clip 70.

Motion of the clip 70 within slot 18 allows for locking and unlocking of the blade 30 with respect to the front handle 10 and back handle 14.

Figure 2:
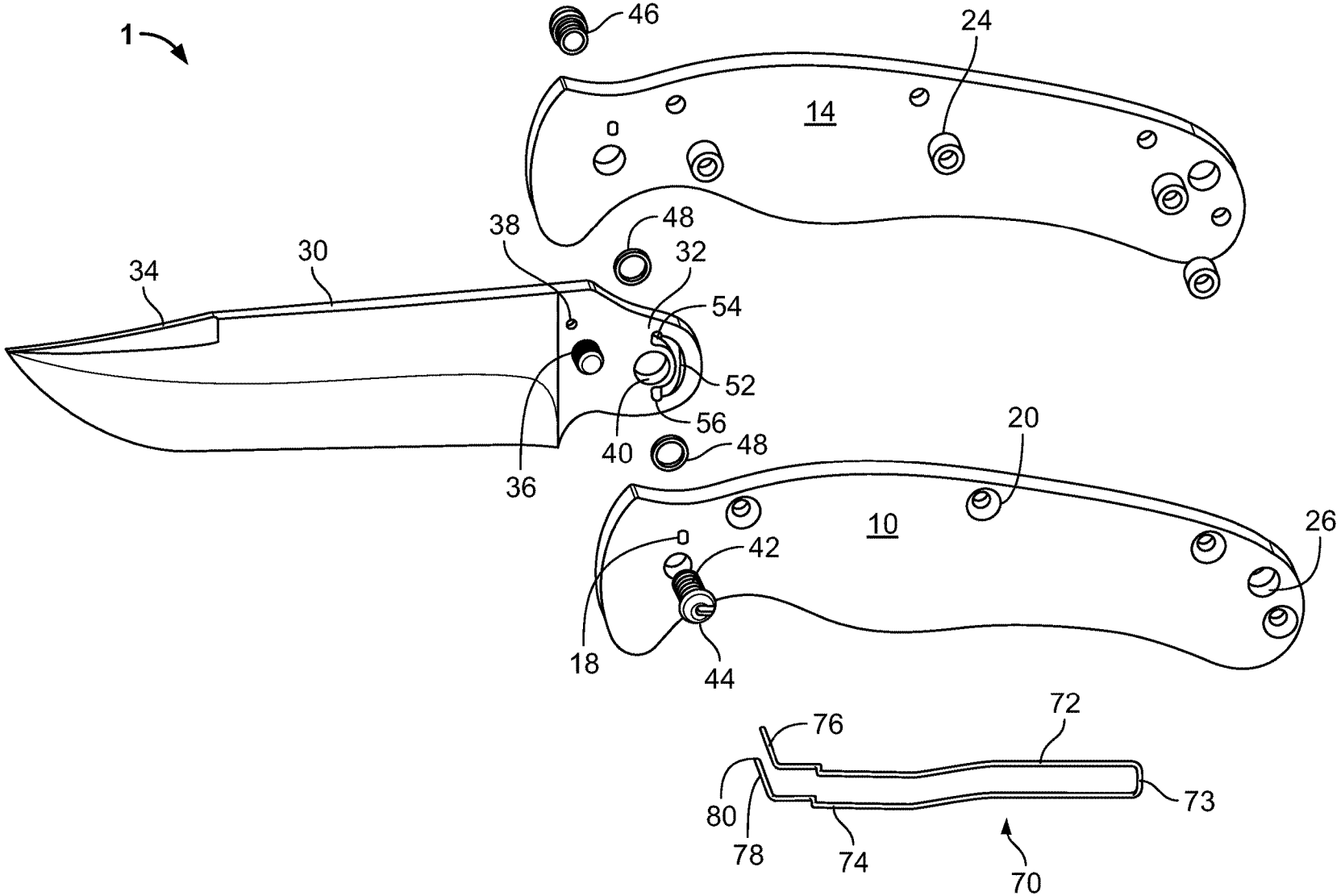
FIG. 2 illustrates a first exploded view of the locking folding knife with clip actuator.

Referring to FIG. 2, a first exploded view of the locking folding knife with clip actuator is shown.

The locking folding knife with clip actuator 1 includes front handle 10 and back handle 14, separated by standoffs 24, affixed via handle holes 20.

The includes blade 30 includes tang 32, which includes the locking mechanism. The blade 30 is shown as a clip point blade 34, but other blade types are equally suitable.

An optional thumbstud 36, threaded into thumbstud hole 38, simplifies the motion of opening and closing the blade 30.

The blade rotates about pivot hole 40, separated from the front handle 10 and back handle 14 by bushing 42 and washers 48.

The bushing 42 includes a bushing slot 44, and is held in place when assembled by bushing screw 46.

The clip 70 acts to hold the locking folding knife with clip actuator 1 to a pair of pants, or any other material that can fit between the clip 70 and the front handle 10.

The clip 70 is formed from an upper arm 72 and lower arm 74 joined via a section that acts as a hinge 73. The hinge 73 is preferably a continuation of the upper arm 72 and lower arm 74, rather than a discrete piece of material. Alternatively, the hinge 73 is separable from the clip 70.

The upper arm 72 of the clip 70 terminates at the upper pin 76. The lower arm 74 of the clip 70 terminates at the lower pin 78.

The blade 30 rotates about pivot 50. The upper pin 76 sits within curved slot 52 when in an unlocked position, and sits within lock-open detent 54, lock-closed detent 56, or finger-stop detent 58 (see FIG. 3) when in a locked position.

Lower pin 78 is optionally threaded at threaded tip 80 that interacts with bushing screw 46.

Also shown is lanyard hole 26 for passing through a cord to allow the locking folding knife with clip actuator 1 to be attached to a backpack or other item.

Figure 3:
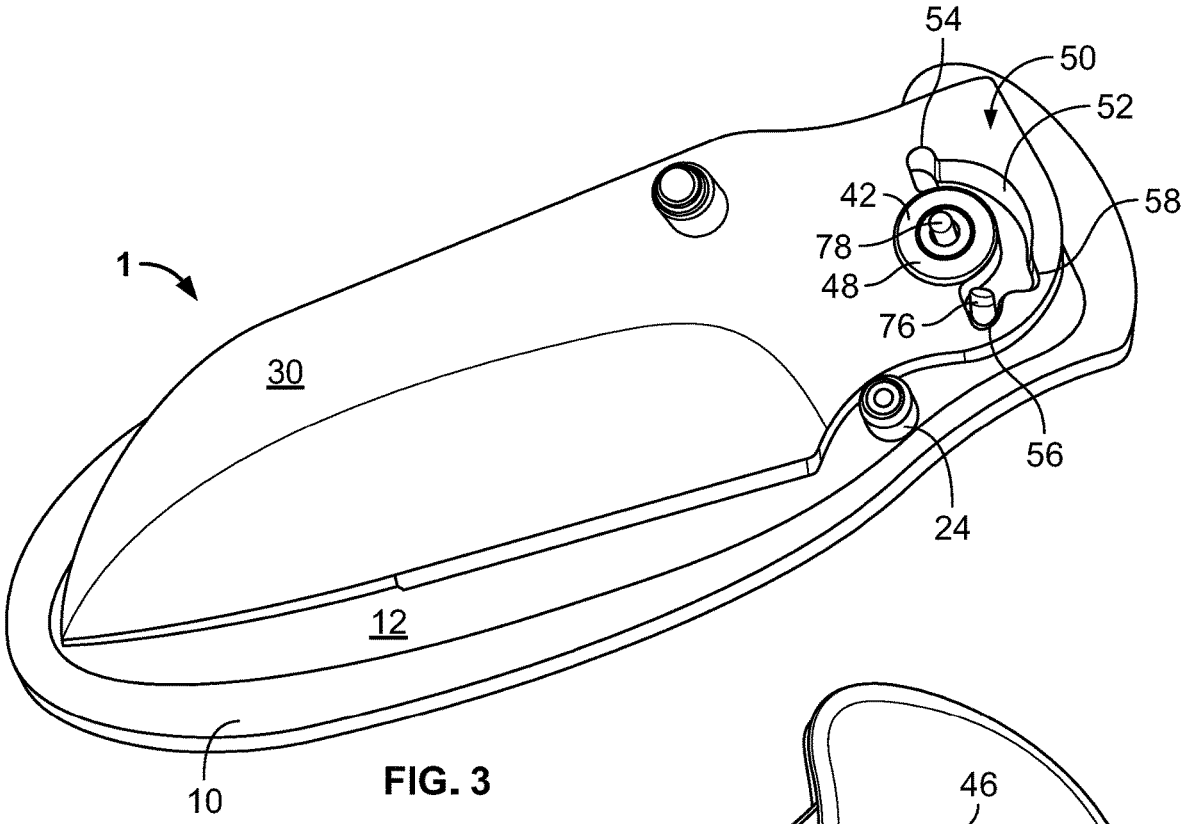
FIG. 3 illustrates a partially disassembled view of the locking folding knife with clip actuator.
Figure 4:
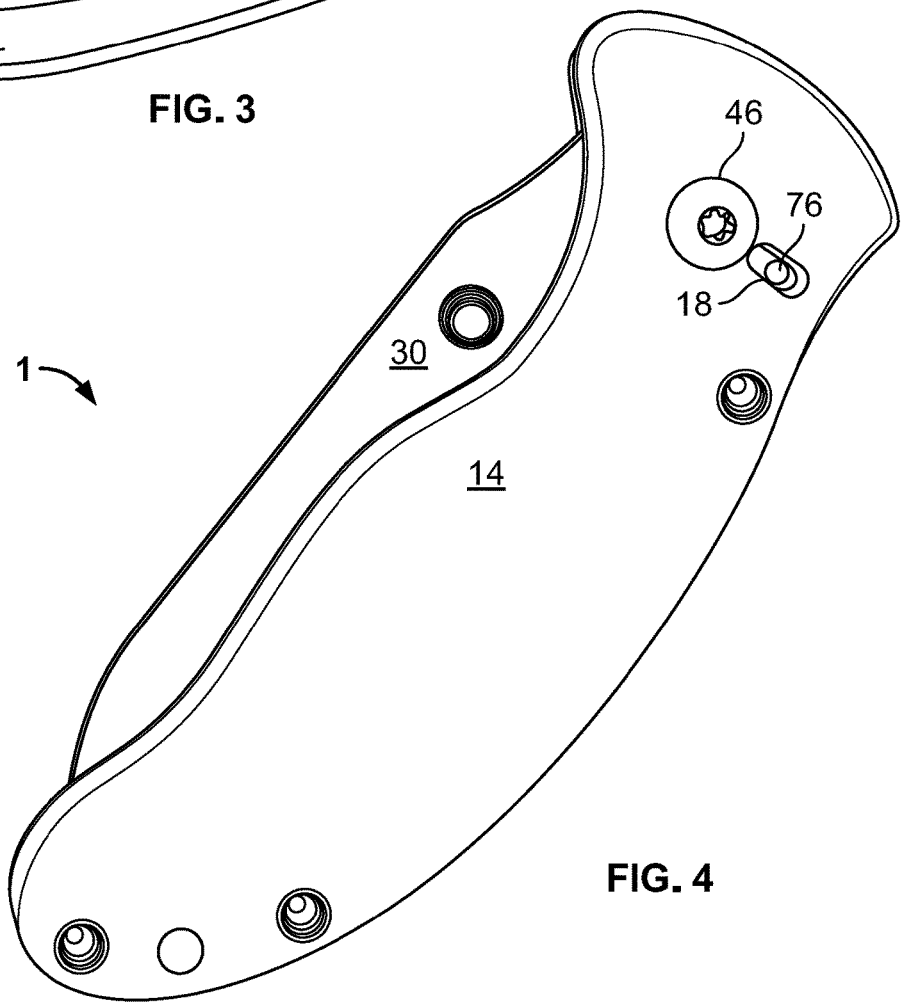
FIG. 4 illustrates an assembled and closed view of the locking folding knife with clip actuator.

Referring to FIGS. 3 and 4, a partially disassembled view, and an assembled and closed view, of the locking folding knife with clip actuator are shown.

The front handle 10 is shown with front bolster 12 for reinforcement.

The blade 30 rotates about pivot 50, the center of rotation being the lower pin 78. One or more optional washers 48 separate the blade 30 and bushing 42 from the front handle 10 and back handle 14

The upper pin 76 slides within curved slot 52, but prefers to move out of the curved slot 52 and into the lock-open detent 54, lock-closed detent 56, or finger-stop detent 58.

When viewed from the back handle 14, the upper pin 76 slides within the slot 18.

When the upper pin 76 is locked within a detent 54/56/58, the position of the blade 30 with respect to the handles 10/14 is maintained.

Figure 5:
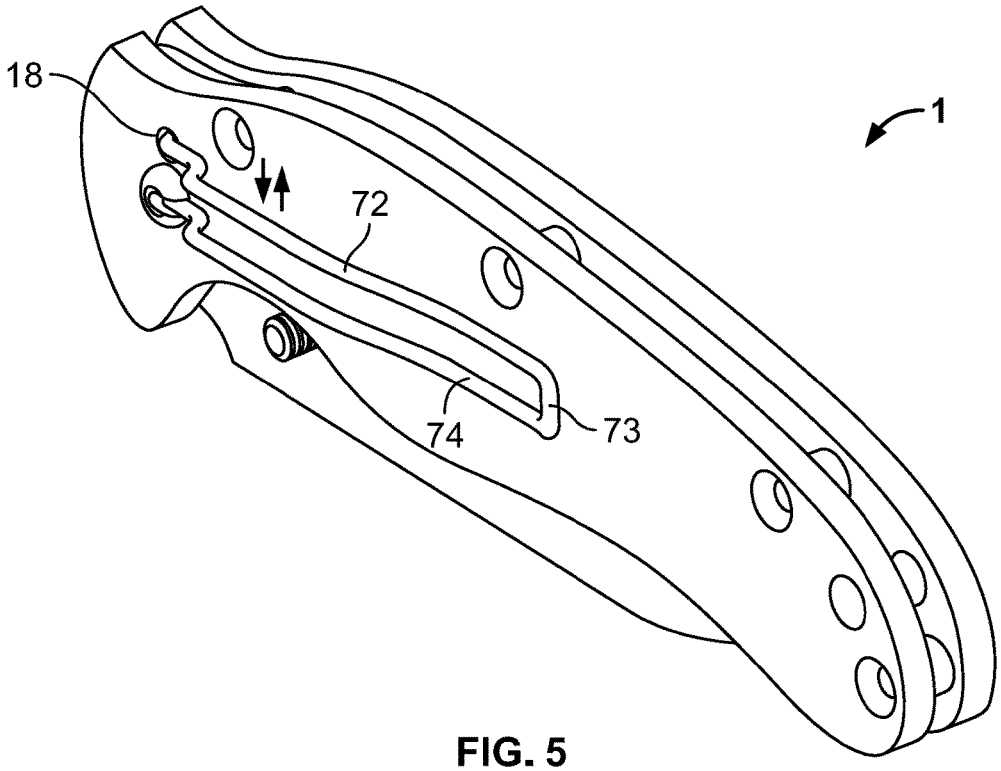
FIG. 5 illustrates a second isometric view of the locking folding knife with clip actuator.
Figure 6:
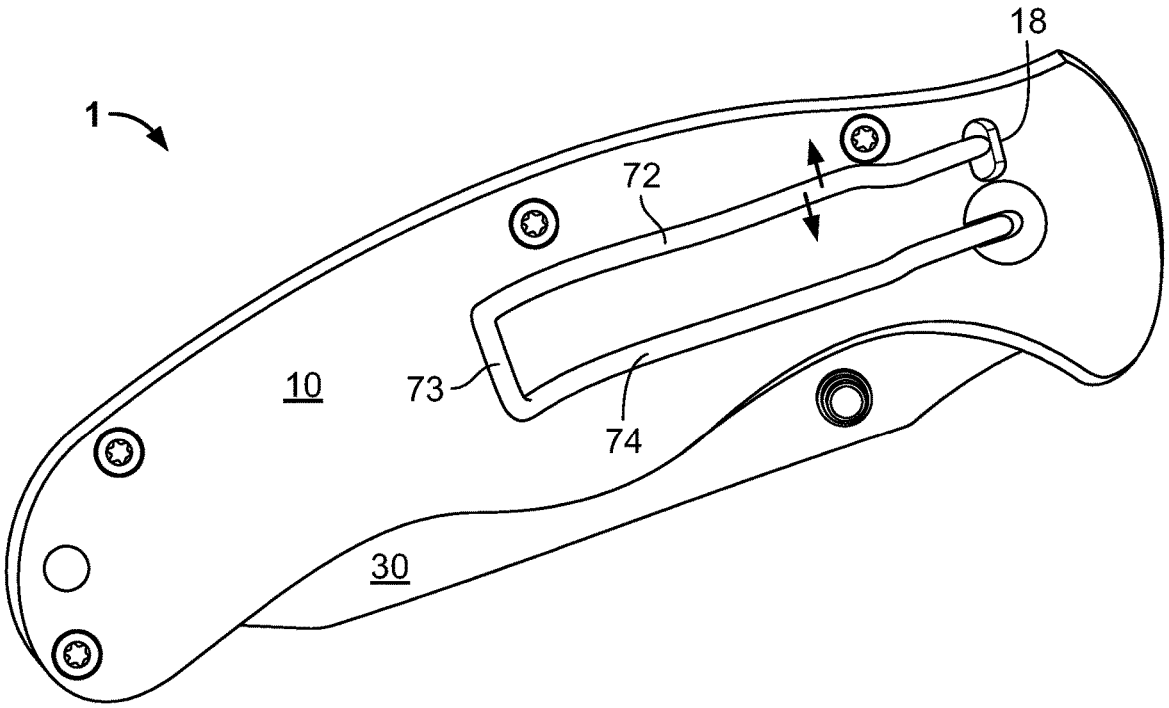
FIG. 6 illustrates a third isometric view of the locking folding knife with clip actuator.
Figure 7:
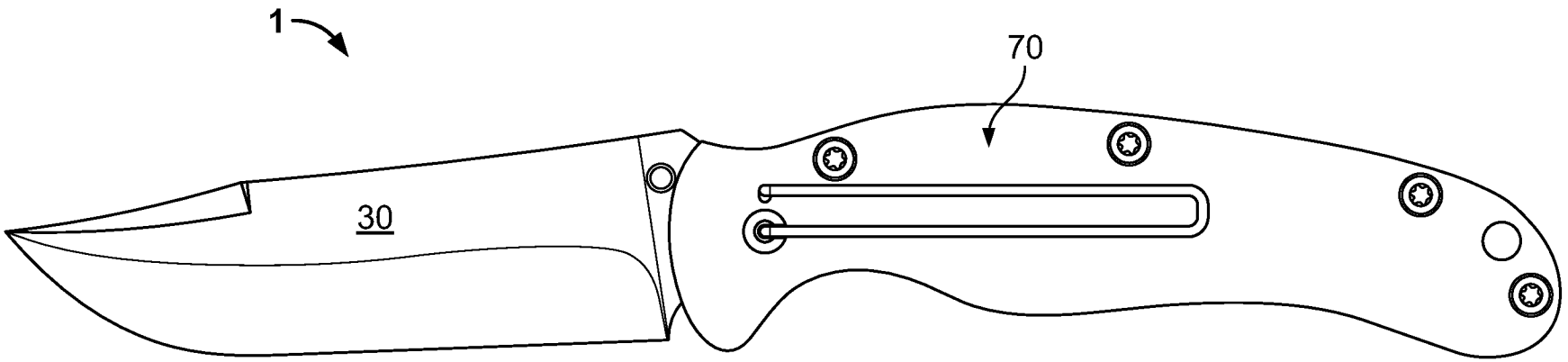
FIG. 7 illustrates a left-side view of the locking folding knife with clip actuator.
Figure 8:
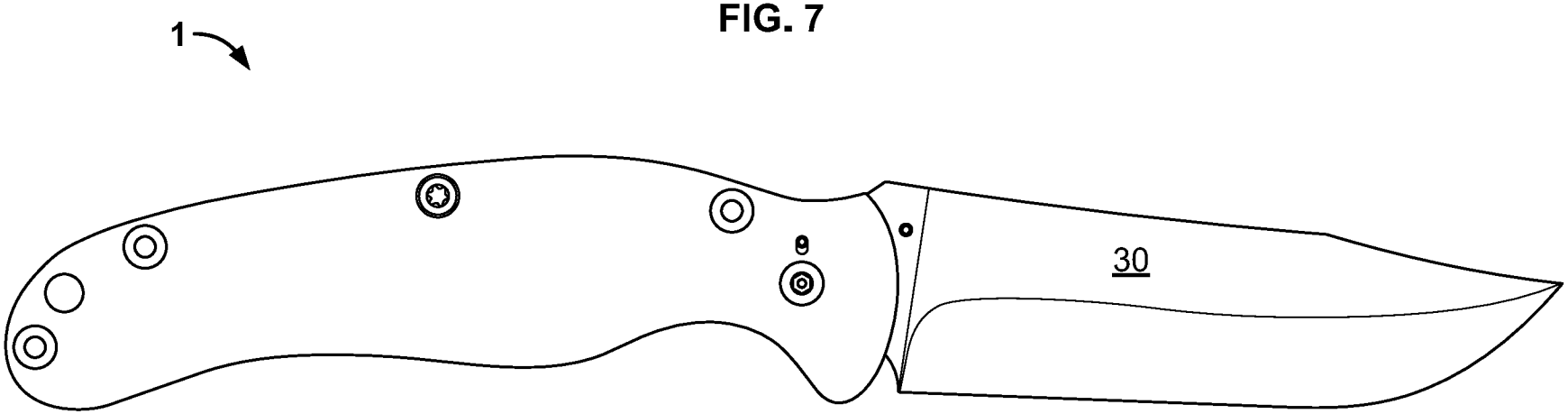
FIG. 8 illustrates a right-side view of the locking folding knife with clip actuator.
Figure 10:
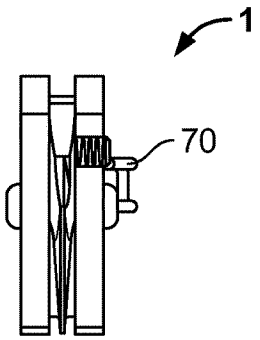
FIG. 10 illustrates a front view of the locking folding knife with clip actuator.
Figure 9:
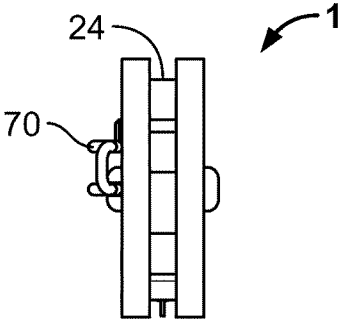
FIG. 9 illustrates a back view of the locking folding knife with clip actuator.

Referring to FIGS. 5 and 6, a second isometric view and third isometric view of the locking folding knife with clip actuator are shown.

The clip 70 is shown, with arrows showing the motion directions of the upper arm 72, flexing at hinge 73 to create motion within slot 18.

Also shown is lower arm 74.

Referring to FIGS. 7-13, additional views of the locking folding knife with clip actuator are shown.

Figure 11:
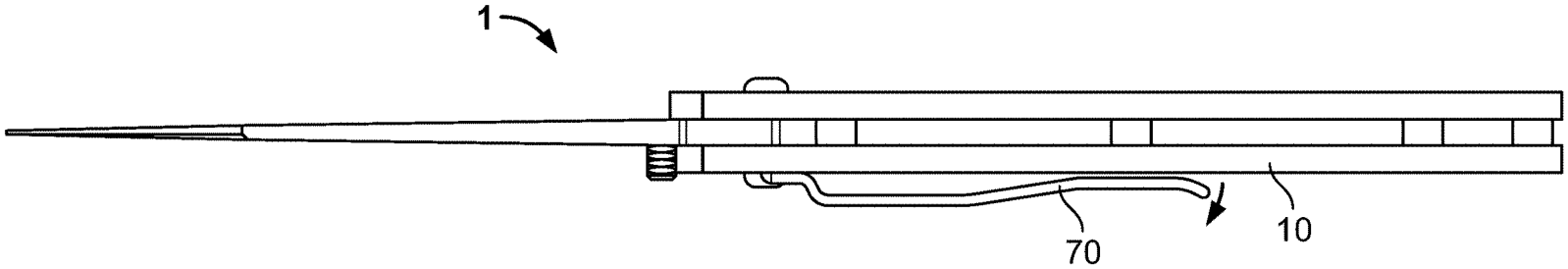
FIG. 11 illustrates a top view of the locking folding knife with clip actuator.
Figure 12:
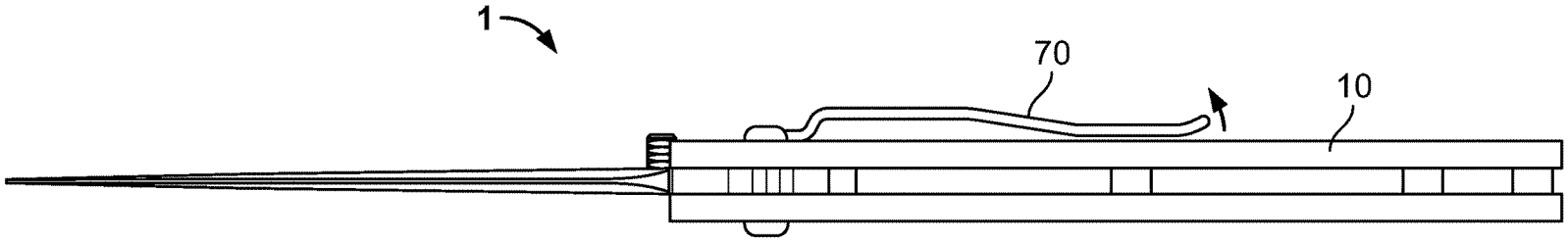
FIG. 12 illustrates a bottom view of the locking folding knife with clip actuator.
Figure 13:
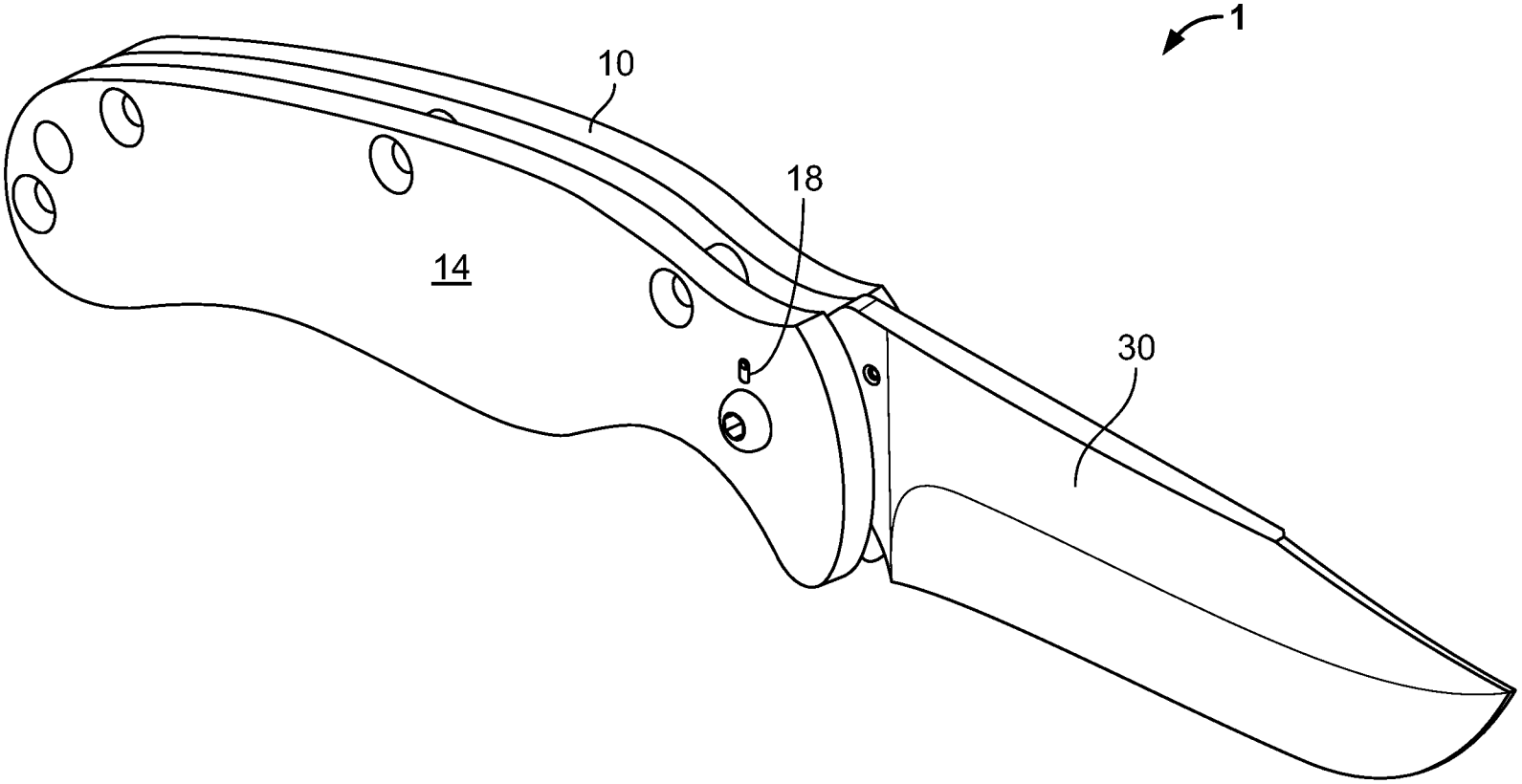
FIG. 13 illustrates a fourth isometric view of the locking folding knife with clip actuator.

FIGS. 11 and 12, show the clip 70 with arrows indicating motion of the clip 70 when the locking folding knife with clip actuator 1 is clipped to a pair of pants or other material.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction, and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A folding knife for a user, the folding knife comprising:
a blade having an open position and a closed position;
the blade including a curved slot;
a clip;
the clip including an upper arm ending in an upper pin and a lower arm ending in a lower pin;
the blade rotating about the lower pin;
the upper pin sliding within the curved slot of the blade;
the clip allows the folding knife to attach to a planar surface, such as a pant pocket;
a lock-open detent extending from the curved slot;
the upper pin sitting within the lock-open detent when the blade is in the open position;
a lock-closed detent extending from the curved slot;
the upper pin sitting within the lock-closed detent when the blade is in the closed position;
whereby compression of the clip causes the upper pin to move out of the lock-open detent or the lock-closed detent and into the curved slot, thus allowing motion of the blade.

2. The folding knife of claim 1, further comprising:
a finger-stop detent extending from the curved slot;
the finger-stop detent between the lock-open detent and the lock-closed detent;
whereby the finger-stop detent holds the knife blade in a partially-open position, thus reducing an ability of the user to accidently close the blade on his fingers.

3. A folding knife comprising:
a blade;
the blade including a curved slot;
a handle;
a clip;
the clip having a resting position and a squeezed position;
the resting position holding the blade in a fixed position with respect to the handle;
the squeezed position allowing the blade to move with respect to the handle;
an upper arm ending in an upper pin;
the upper pin sliding within the curved slot;
the upper pin controlling whether the blade can move with respect to the handle;
a lock-open detent extending from the curved slot;
the upper pin sitting within the lock-open detent when the blade is in an open position;
a lock-closed detent extending from the curved slot;
the upper pin sitting within the lock-closed detent when the blade is in a closed position;
a lower arm ending in a lower pin;
the blade rotating about the lower pin;
whereby compression of the clip causes the upper pin to move out of the lock-open detent or the lock-closed detent and into the curved slot, thus allowing motion of the blade; and
whereby the folding knife is folded and unfolded by squeezing the clip and pushing on, or pulling, the blade with respect to the handle.

4. The folding knife of claim 3, wherein the clip allows the folding knife to grip an object such as a pants pocket.

5. The folding knife of claim, 3 further comprising:
a finger-stop detent extending from the curved slot;
the finger-stop detent between the lock-open detent and the lock-closed detent;
whereby the finger-stop detent holds the blade folding knife in a partially-open position, thus reducing the ability of a user to accidently close the blade on his fingers.

6. A locking folding knife comprising:
a blade;
the blade including a pivot hole and a curved slot;
an actuation mechanism that controls a position of the blade with respect to a handle;
the actuation mechanism including a clip;
the clip formed from an upper arm and a lower arm;
the upper arm interfacing with the curved slot of the blade;
the lower arm interfacing with the pivot hole of the blade;
compressing the upper arm toward the lower arm causes the clip to deform, moving the upper arm toward the lower arm and causing the actuation mechanism to unlock the blade; and
releasing the upper arm causes the clip to return to its original shape and to move away from the lower arm causing the actuation mechanism to lock the blade;

whereby the clip allows the locking folding knife to grip a pocket, holding the locking folding knife in place, the clip also acting to lock and unlock the blade with respect to the handle.

7. The locking folding knife of claim 6, further comprising:

an upper pin extending from the upper arm of the clip; the upper pin constrained within the curved slot of the blade;

a lower pin extending from the lower arm of the clip; the blade and handle able to rotate with respect to each other around the lower pin, the lower pin creating an axis of rotation;

whereby the clip is integrated into actuation mechanism, the clip controlling whether the blade can rotate with respect to the handle.

8. The locking folding knife of claim 7, further comprising:

a bushing separating the lower pin from the blade, and separating the lower pin from the handle;

whereby the bushing allows for easy rotation of the locking folding knife with respect to the lower pin.

9. The locking folding knife of claim 7, the blade further comprising:

a lock-open detent extending from the curved slot; the upper pin sitting within the lock-open detent when the blade is in an open position;

a lock-closed detent extending from the curved slot; the upper pin sitting within the lock-closed detent when the blade is in a closed position;

whereby compression of the clip causes the upper pin to move out of the lock-open detent or the lock-closed detent and into the curved slot, thus allowing motion of the blade.

10. The locking folding knife of claim 9, further comprising:

a finger-stop detent extending from the curved slot; the finger-stop detent between the lock-open detent and the lock-closed detent;

whereby the finger-stop detent holds the knife blade in a partially-open position, thus reducing an ability of a user to accidently close the blade on his fingers.

11. The locking folding knife of claim 9, wherein:

the handle surrounds a locking mechanism formed from the curved slot, lock-open detent, and lock-closed detent;

whereby the handle protects a user's hand from motion of the locking mechanism and the blade.

* * * * *